US005183107A

United States Patent [19]

Le Gauyer

[11] Patent Number: 5,183,107

[45] Date of Patent: Feb. 2, 1993

[54] TUBULAR MANIFOLD FOR A HEAT EXCHANGER AND A METHOD OF MAKING IT

[75] Inventor: Philippe Le Gauyer, Paris, France

[73] Assignee: Valeo Thermique Moteur, Le Mesnil-Saint Denis, France

[21] Appl. No.: 879,027

[22] Filed: May 6, 1992

[51] Int. Cl.[5] ..... F28F 9/02

[52] U.S. Cl. ..... 165/176; 165/174; 29/890.052

[58] Field of Search ..... 165/150, 174, 176; 29/890.052

[56] References Cited

FOREIGN PATENT DOCUMENTS

| | | | |
|---|---|---|---|
| 1057148 | 5/1959 | Fed. Rep. of Germany | 165/176 |
| 1098530 | 2/1961 | Fed. Rep. of Germany | 165/176 |
| 56253 | 5/1944 | Netherlands | 165/150 |
| 5775 | 1/1892 | United Kingdom | 165/174 |
| 8391 | 4/1902 | United Kingdom | 165/174 |

*Primary Examiner*—Allen J. Flanigan
*Attorney, Agent, or Firm*—Morgan & Finnegan

[57] ABSTRACT

A heat exchanger, finding its application typically as a cndenser in an air conditioning installation for a motor vehicle, comprises a fluid manifold having an elongated tubular wall which carries internal transverse baffles, together with a number of parallel heat exchange tubes penetrating into the manifold through apertures formed in the tubular wall. The transverse baffles are entirely located within the tubular wall and are secured to a connecting member which is elongated along the axis of the tubular wall, which enables the baffles to be fitted simultaneously and held in place, and which also serves as an abutment for the ends of the heat exchange tubes.

9 Claims, 3 Drawing Sheets

TUBULAR MANIFOLD FOR A HEAT EXCHANGER AND A METHOD OF MAKING IT

FIELD OF THE INVENTION

This invention relates to heat exchangers of the kind comprising at least one fluid manifold having an elongated tubular wall and at least two transverse baffles carried by the said tubular wall, together with a multiplicity of parallel heat exchange tubes penetrating into the manifold through apertures formed for this purpose in the tubular wall.

BACKGROUND OF THE INVENTION

One such heat exchanger, which finds particular application as a condenser in an air conditioning installation for a motor vehicle, is described in the specification of published European patent application No. EP 0 360 362A. In that document, the heat exchanger has a tubular wall which is formed with diameticral slots, with each baffle being introduced laterally through one of these slots and having an appropriate contour such that it is able to abut against the ends of the same slot. The baffle is thus located in position, and is subsequently brazed to the tubular wall. A drawback of this arrangement is that manufacture of the tubular wall is complicated by the need to form the slots by machining, and in addition the baffles have an irregular shape. The slots also give rise to possible additional leakage paths.

The above mentioned European patent specification also envisages the provision of means for limiting penetration of the heat exchange tubes into the manifold. These limiting means consist of shoulders or projections which are formed on the outside of the tubes and which come into abutment against the tubular wall. This arrangement calls for individual machining of each heat exchange tube.

DISCUSSION OF THE INVENTION

An object of the invention is to overcome at least some of the above mentioned drawbacks.

According to the invention in a first aspect, a heat exchanger comprisies at least one fluid manifold having an elongated tubular wall and at least two transverse baffles carried therein and fixed to a connecting member which is elongated in the direction of the axis of the tubular wall, together with a multiplicity of parallel tubes penetrating into the manifold through apertures formed in the tubular wall. It is characterised in that the connecting member is in the form of a bar formed with slots, spaced apart from each other in the longitudinal direction of the said bar for receiving the transverse baffles, with each baffle being formed with a further slot for receiving the bar, the latter being substantially in contact with the tubular wall in a region diametrically opposed to the said apertures.

Preferably, the transverse baffles comprise two endmost baffles which, with the tubular wall, together define the internal space of the fluid manifold. In addition, the transverse baffles preferably include at least one intermediate baffle dividing the manifold into at least two compartments, with some of the heat exchange tubes being open into each compartment.

According to a further preferred feature of the invention, the ends of the tubes abut against the said connecting member. This limits penetration of each heat exchange tube into the manifold in a uniform manner.

The peripheral edges of the transverse baffles and/or the tubes are preferably brazed to the tubular wall.

In a heat exchanger in one form in accordance with the invention, the connecting member is in the form of a bar formed with slots that are spaced apart in a longitudinal direction for receiving the transverse baffles, with each baffle also having a further slot for receiving the bar, and with the bar being substantially in contact with the tubular wall in a position diametrically opposed to the above mentioned apertures in which the ends of the heat exchange tubes are received.

In another form of heat exchanger in accordance with the invention, the said bar is in the form of a cradle member having a transverse cross section in the form of an arc of a circle, the said bar having transverse openings which are spaced apart from each other in the longitudinal direction of the bar, each baffle having along its perimeter a recess the depth and circumferential length of which correspond to the thickness and the length of arc defined by the cradle member, with the said recess being interrupted by a radial projecting element which engages in a said opening of the cradle member so as to secure the baffle to the cradle member, the latter being in engagement on the tubular wall in a region diametrically opposed to the said apertures accommodating the tubes.

According to a preferred feature of each of these two last mentioned forms of heat exchanger according to the invention, the connecting member is formed with a multiplicity of slots or openings spaced apart at regular intervals, with only some of them being associated with transverse baffles, depending on the length of the compartments that are to be formed in the manifold. A single design of connecting member can thus be used for manifolds which have the same length as each other but which differ as to the location of the baffles.

According to the invention in a second aspect, there is provided a method of making a heat exchanger in accordance with the invention, in which the connecting member carrying the transverse baffle is introduced into the said tubular wall through an open end of the latter, and is caused to slide longitudinally within the tubular wall until the baffles reach their final positions, prior to introduction of the ends of the tubes into the manifold through the said apertures formed in the tubular wall.

Preferably, the peripheral edges of the transverse baffles and/or the tubes are brazed to the tubular wall by melting of a fusible metallic coating which is provided on at least one of the components to be brazed.

Further features and advantages of the invention will appear more clearly from the detailed description of preferred embodiments of the invention given below, by way of example only and with reference to the accompanying drawings.

DESCRIPTION OF PREFERRED EMBODIMENTS OF THE INVENTION

Figure 1:
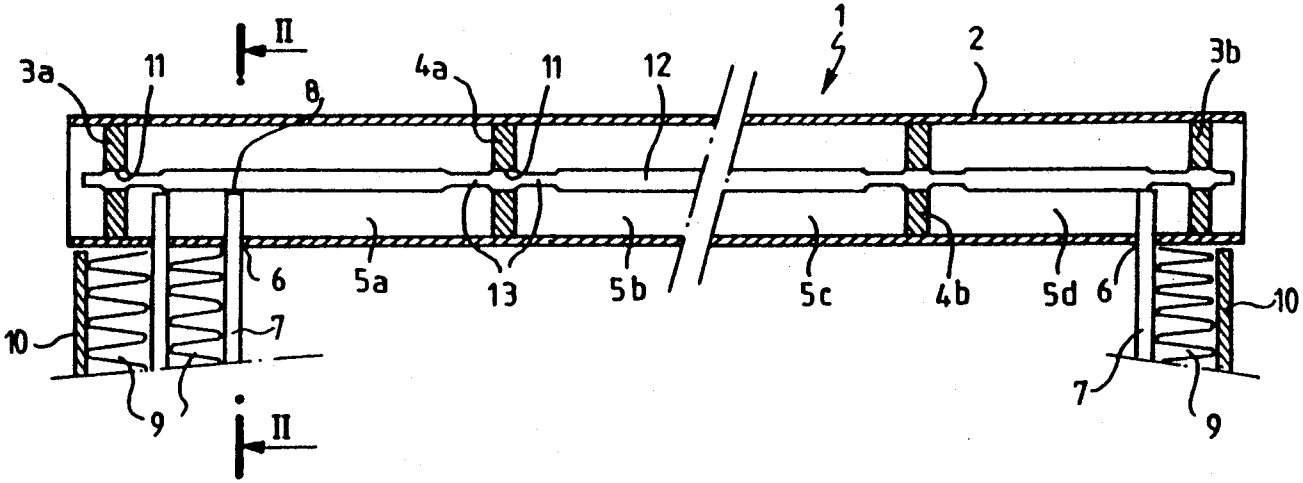
FIG. 1 is a view in longitudinal cross section showing part of a heat exchanger in accordance with the present invention, the section being taken on the line I—I in FIG. 2.
Figure 2:
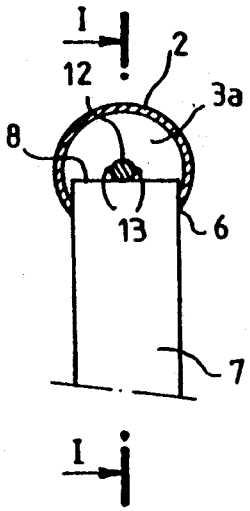
FIG. 2 is a partial view in cross section taken on the line II—II in FIG. 1.

The heat exchanger which is shown in part in FIGS. 1 and 2 is typically designed to act as a condenser in an air conditioning installation for the cabin of a motor vehicle. It comprises a fluid manifold 1 having a tubular wall 2 which is closed in the vicinity of its ends by means of two transverse baffles 3*a* and 3*b*, so as to define an interior space which is sub-divided by intermediate transverse baffles 4*a*, 4*b* into a number of compartments 5*a*, 5*b*, 5*c*, 5*d*. The reference numerals 5*b* and 5*c* correspond to two different compartments or, alternatively, to the same compartment, depending on whether or not there is at least one further baffle, not shown, between the baffles 4*a* and 4*b*.

The tubular wall 2 is formed with a multiplicity of apertures 6, with a tube 7 being engaged in each of these apertures. The transverse cross section of each tube 7 is elongated in the direction transverse to the manifold 1, the tubes 7 being parallel to each other and extending at right angles to the longitudinal direction of the manifold. An open end 8 of each of the tubes 7 lies within the manifold 1, with its opposite end being able to be located within a further manifold (not shown). This further manifold is typically similar to the manifold 1 and extends parallel to it. Inserts 9, comprising bands of sheet metal which are curved substantially in the form of a sine wave, are located in the spaces between the tubes 7, or between a tube 7 and an end plate 10, in such a way as to be in thermal contact with the tubes 7.

Figure 3:
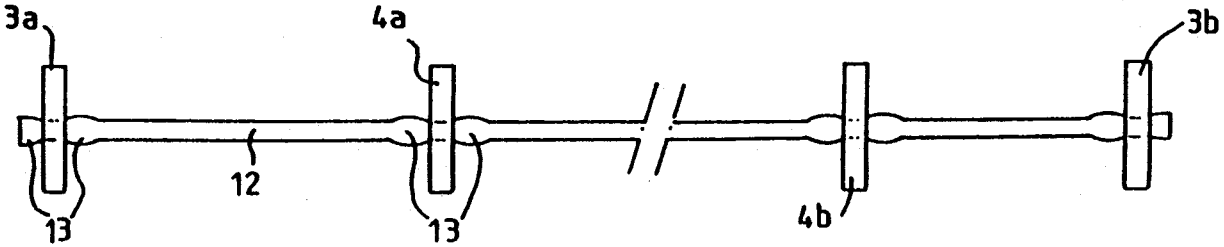
FIG. 3 shows a sub-assembly of the same heat exchanger, in plan view with reference to FIG. 1.

The baffles 3 and 4, which are substantially identical to each other and in the form of circular discs, are formed with a circular central opening 11 in which an elongated cylindrical bar 12 is engaged with substantially no clearance. The bar 12 is common to all of the transverse baffles, and acts as a connecting member between them. The bar 12 is flattened by means of a mechanical operation in zones 13 adjacent to the baffles and on either side of the latter, so as to define bulges which, as shown in FIG. 3, extend radially in a direction transverse to the direction in which the bar is flattened. These bulges immobilise the baffles 3 and 4 in the longitudinal direction of the bar 12.

The sub-assembly shown in FIG. 3, and comprising the bar 12 with the baffles 3 and 4 carried by it, is introduced during assembly of the heat exchanger into the interior of the tubular wall 2 through one of the open ends of the latter. It is then slid along the wall 2, with the edges of the baffles 3 and 4 sliding against the internal surface of the wall until the baffles reach the positions which they are to occupy in the completed heat exchanger. The tubes 7 are then introduced through the aperture 6, which may have been formed either before or after fitting of the sub-assembly 3, 4, 12, until their ends 8 come into engagement against the bar 12.

Sealing between the outer surface of the tubes 7 and the aperture 6, and between the edges of the baffles 3 and 4 and the internal surface of the tubular wall 2, is obtained by brazing using a fusible metallic coating, which may be melted by heating the assembled heat exchanger. This coating is preferably applied on the outer surface of the tubular wall 2 for joining it to the tubes 7, and also on the baffles for joining them to the tubular wall 2. There is however no such coating on the internal surface of the tubular wall 2, so as to avoid any possibility of partial obstruction of the ends of the tubes 7.

Figure 4:
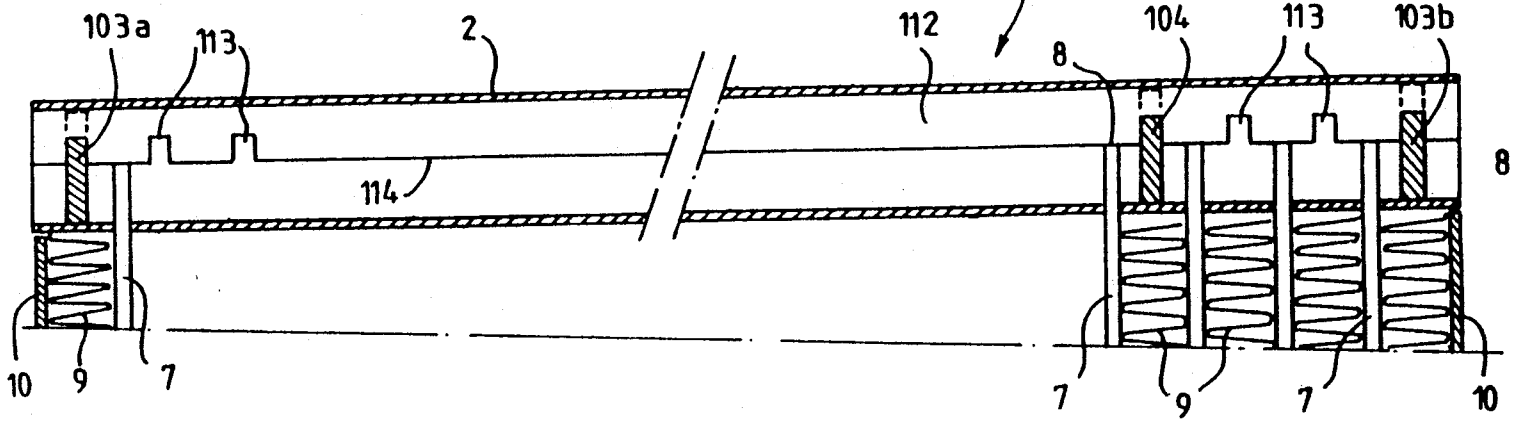
Figure 10:
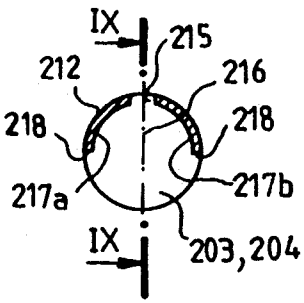
FIG. 10 is a view in cross section taken on the line X—X in FIG. 9.

The general structure and method of assembly of heat exchangers shown in FIGS. 4 to 10 are the same as those of the heat exchanger shown in FIGS. 1 to 3, and those elements of the heat exchangers in the two versions shown in FIGS. 4 and 10 are indicated by the same reference numerals. It is only the transverse baffles and the profiled member which differ as between the different embodiments shown in the drawings. This will be explained below.

Figure 5:
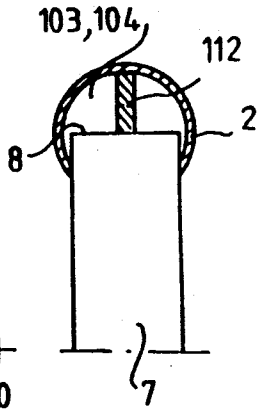
FIGS. 4 and 5 are views similar to FIGS. 1 and 2 respectively, showing another heat exchanger in accordance with the invention.
Figure 6:
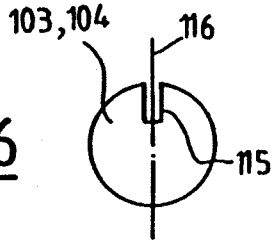
FIG. 6 shows a transverse baffle of the heat exchanger seen in FIGS. 4 and 5.

In the heat exchanger shown in FIGS. 4 to 6, the cylindrical bar 12 in the first embodiment described above is replaced by a bar 112 having a rectangular transverse cross section. The bar 112 is formed with a multiplicity of slots 113 which are spaced at regular intervals along its length, all of these slots being formed in a common narrow edge 114 of the bar 112. Each slot 113 extends through the whole thickness of the bar 112, so that the latter has the shape of a rack. The slots are delimited by surfaces lying at right angles to the longitudinal direction of the bar 112.

The endmost transverse baffle 103*a*, 103*b* and the intermediate transverse baffles 104, only one of which is shown in FIG. 4, are in the form of circular discs, the thickness of which is substantially equal to the width of a slot 113. Each of these baffles has a radial slot 116, see FIG. 6, which extends over the whole thickness of the baffle. The slot 115 is symmetrical with respect to an axial plane 116 of the baffle, and has a uniform width corresponding to that of the rectangular bar 112. The sum of the depths of a slot 113 and a slot 115 is substantially equal to the length of the rectangular cross section of the bar 112, in such a way that each baffle can be interlocked on the bar 112 at a respective one of the slots 113 as shown in FIGS. 4 and 5. The profile of the bar 112 does not project from the circult contour defined by the baffles 103, 104. The sub-assembly comprising the bar 112 and the various baffles associated with it is mounte din the heat exchanger in the same way as was the sub-assembly 3, 4, 12 described above with reference to FIGS. 1 to 3. The tubes 7 then abut against the edge 114 of the bar 112.

Figure 7:
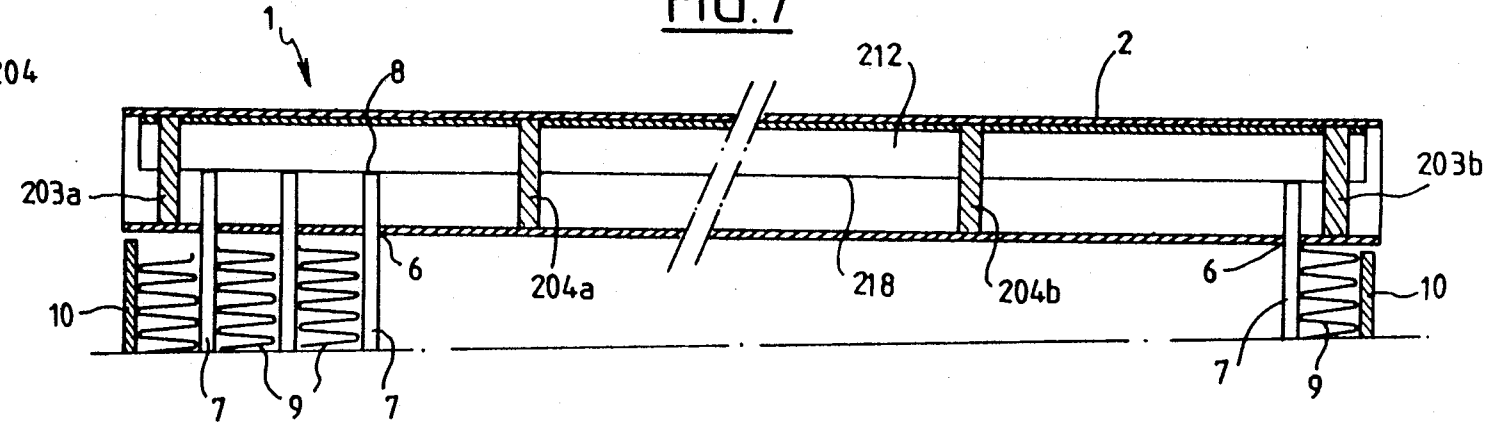
FIGS. 7 and 8 are views similar to FIGS. 1 and 2 respectively, but show a third heat exchanger in accordance with the invention.
Figure 8:
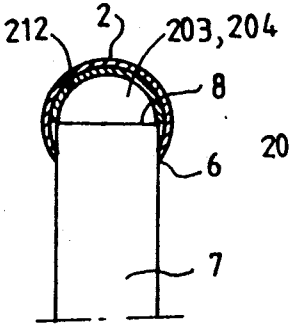
Figure 9:
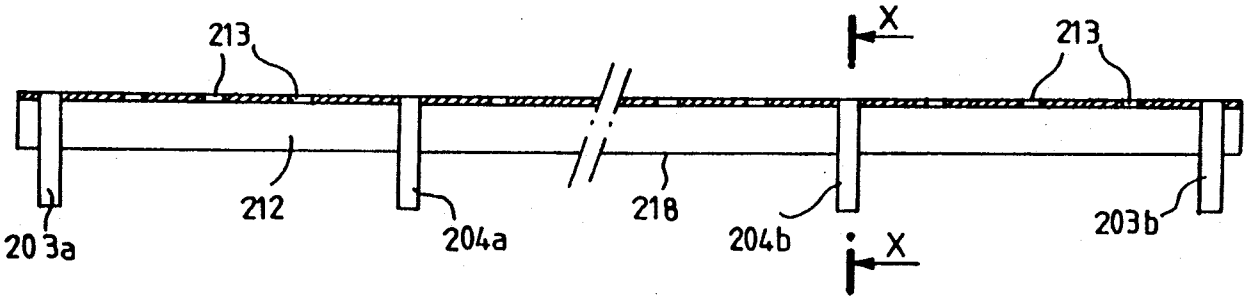
FIG. 9 shows the sub-assembly constituted by the transverse baffles and the cradle-shaped profiled member of the heat exchanger shown in FIGS. 7 and 8, the profiled member being shown in cross section taken on the line IX—IX in FIG. 10.

Referring now to FIGS. 7 and 10, the connecting member, substantially corrseponding to the bar 12 in the first embodiment or 112 in the second embodiment described above, here takes the form of a cradle member having a semi-circular circular cross section. This cardle member is formed with a multiplicity of holes 213, which are aligned in tis longitudinal plane of symmetry and which are spaced apart at regular intervals. The baffles here comprise endmost transverse baffles 203*a* and 203*b*, together with intermediate transverse baffles 204*a* and 204*b*, the baffles being substantially identical to each other. As is best seen in FIG. 10, each of these baffles is generally in the form of a circular disc, the edge of which has a recess in two parts 217*a*, 217*b* which are symmetrical with each other about an axial plane 216. The two parts 217*a* and 217*b* of the recess are separated from each other by an unrecessed zone 215 which extends over a short arc on either side of the plane 216. The recess 217*a*, 217*b* and the zone 215 together extend over one half of the circumference of the baffle, and the depth of the recess corresponds to the thickness of the cradle member 212.

Each baffle 203, 204 may thus be located in the cradle member 212 in such a way that the projecting zone 215 engages in a respective one of the holes 213 in the cradle member. The profile of the cradle member then fills the recess 217*a*, 217*b* so as to complete the circular contour of the baffle. The holes 213 may be slightly flared towards the outside of the cradle member, so as to enable the projections 215 to be deformed into the form of a rivet.

During fitting of the sub-assembly comprising the cardle member 212 and the baffles 203 and 204, the outer surface of the cradle member enages on the inner surface of the tubular wall 2, in that half of the circumference of the latter which is opposite to the apertures 6. The ends 8 of the tubes 7 are abutted against the longitudinal edges 218 of the cradle member 212.

In the two embodiments of heat exchanger according to the invention described in FIGS. 4 to 10, only some of the slots 113 or holes 213 are used for reception of the baffles, according to the number and mutual spacing of the latter.

What is claimed is:

1. A heat exchanger comprising at least one fluid manifold having an elongated tubular wall, at least two transverse baffles carried by the said tubular wall, and a connecting member joining the said baffles together, the connecting member being of elongate shape extending in the axial direction of the tubular wall, the heat exchanger further comprising a multiplicity of heat exchange tubes, the tubular wall being formed with a multiplicity of apertures, each heat exchange tube being received in a respective said aperture so as to penetrate into the manifold, wherein the connecting member is a bar formed with a multiplicity of slots spaced apart along the said bar for receiving the said baffles, with each baffle comprising a further slot for receiving the said bar, the latter being substantially in contact with the tubular wall in a region of the latter diametrically opposed to the said apertures in which the heat exchange tubes are received.

2. A heat exchanger according to claim 1, wherein the transverse baffles comprise two endmost baffles defining with the tubular wall, an internal space of the manifold.

3. A heat exchanger according to claim 1, wherein the transverse baffles include at least one intermediate baffle dividing the manifold into at least two compartments, with each said compartment having at least one said aperture so that the heat exchanger having at least one said aperture so that the heat exchanger tubes are open variously into the said compartments.

4. A heat exchanger according to claim 1, wherein an end of each tube abuts against the connecting member.

5. A heat exchanger according to claim 1 in which each transverse baffle defines a peripheral edge, with at least one of the elements comprising on the one hand the said peripheral edges and on the other hand the heat exchange tubes being brazed to the said tubular wall.

6. A heat exchanger according to claim 1, wherein the said bar is in the form of a cradle member having a transverse cross section defining an arc of a circle, the cradle member being formed with transverse openings which are spaced apart from each other along the cradle member, with each baffle being formed along its perimeter with a recess having a depth and a circumferential length corresponding respectively to the thickness of the cradle member and to the length of the arc defined by the latter, each baffle being further formed with a radial projection interrupting its said recess and engaging in a respective one of the said openings formed in the cradle member for fastening the baffle to the latter, with the cradle member being in engagement on the tubular wall in a region of the latter diametrically opposed to the said apertures in which the heat exchange tubes are received.

7. A heat exchanger according to claim 1, wherein the connecting member is formed with a multiplicity of openings spaced apart from each other at regular intervals, with the transverse baffles being associated with only some of the said openings.

8. A method of making a heat exchanger according to claim 1, including the steps of: fitting the transverse baffles on to the connecting member to form a sub-assembly; introducing the said sub-assembly into the tubular wall through an open end of the latter; causing the sub-assembly to slide longitudinally in the tubular wall until the baffles reach their final position; and subsequently introducing the ends of the heat exchange tubes into the fluid manifold through the said apertures in the tubular wall.

9. A method according to claim 8, further including the steps of: providing a fusible metallic coating on at least one of the components comprising the tubular wall, the heat exhcnage tubes, and the transverse baffles; and, after the said sub-assembly has been fitted in the tubular wall, brazing the tubular wall to the peripheral edges of the other components having the said coating.

* * * * *